US009995095B2

(12) United States Patent
Thibodeaux et al.

(10) Patent No.: US 9,995,095 B2
(45) Date of Patent: Jun. 12, 2018

(54) POWER TONG INTERLOCK SYSTEM

(71) Applicant: Frank's International, Inc., Houston, TX (US)

(72) Inventors: Jarred M. Thibodeaux, Lafayette, LA (US); Charles M. Webre, Lafayette, LA (US); Reese M. Comeaux, Carencro, LA (US)

(73) Assignee: Frank's International, Inc., Houston, TX (US)

( * ) Notice: Subject to any disclaimer, the term of this patent is extended or adjusted under 35 U.S.C. 154(b) by 502 days.

(21) Appl. No.: 14/618,909

(22) Filed: Feb. 10, 2015

(65) Prior Publication Data

US 2015/0275597 A1 Oct. 1, 2015

Related U.S. Application Data

(60) Provisional application No. 61/973,098, filed on Mar. 31, 2014.

(51) Int. Cl.
*E21B 19/16* (2006.01)
*B25B 13/50* (2006.01)

(52) U.S. Cl.
CPC ..... *E21B 19/164* (2013.01)

(58) Field of Classification Search
CPC .... E21B 19/161; E21B 19/164; E21B 19/165; E21B 19/166
USPC ..... 81/57, 57.11
See application file for complete search history.

(56) References Cited

U.S. PATENT DOCUMENTS 4,099,429 A * 7/1978 Hauk ..... E21B 19/168 166/78.1
4,297,922 A * 11/1981 Higdon ..... E21B 19/164 81/57.18
4,843,924 A * 7/1989 Hauk ..... B25B 13/52 81/57.17
5,161,438 A * 11/1992 Pietras ..... E21B 19/164 81/57.16
6,082,225 A * 7/2000 Richardson ..... E21B 19/164 81/57.16
7,281,451 B2 * 10/2007 Schulze Beckinghausen ..... E21B 19/164 81/57.16
2008/0307930 A1 * 12/2008 Veverica ..... E21B 19/164 81/57.34

(Continued)

FOREIGN PATENT DOCUMENTS

CA 2664978 9/2004

OTHER PUBLICATIONS

Canadian Office Action issued in corresponding application No. 2,886,699 dated Jun. 21, 2016, 3 pgs.

*Primary Examiner* — Hadi Shakeri
(74) *Attorney, Agent, or Firm* — Chamberlain Hrdlicka

(57) ABSTRACT

A power tong assembly includes a power tong and an interlock system operably coupled to the power tong. The power tong is configured to grip and rotate a tubular segment in a first direction to make-up a threaded connection with the tubular segment and in a second direction to break-out the threaded connection with the tubular segment. The interlock system is configured to selectively allow the power tong to rotate the tubular segment in one of the first direction and the second direction unrestricted while restricting the power tong to rotate the tubular segment in the other of the first direction and the second direction at a limited speed.

8 Claims, 13 Drawing Sheets

(56) References Cited

U.S. PATENT DOCUMENTS

2013/0255446 A1* 10/2013 Taggart ..... E21B 19/161
81/57.11

* cited by examiner

POWER TONG INTERLOCK SYSTEM

BACKGROUND

In oilfield exploration and production operations, various oilfield tubular members are used to perform important tasks, including, but not limited to, drilling the wellbore and casing a drilled wellbore. For example, a long assembly of drill pipes, known in the industry as a drill string, may be used to rotate a drill bit at a distal end to create the wellbore. Furthermore, after a wellbore has been created, a casing string may be disposed downhole into the wellbore and cemented in place to stabilize, reinforce, or isolate (among other functions) portions of the wellbore. As such, strings of drill pipe and casing may be connected together, such as end-to-end by threaded connections, in which a male "pin" end of a first tubular member is used to threadably engage a corresponding female "box" end of a second tubular member. Alternatively, a tubular string may be made-up of a series of male-male ended tubular joints coupled together by female-female couplers. The process by which the threaded connections are assembled is called "making-up" a threaded connection, and the process by which the connections are disassembled is referred to "breaking-out" the threaded connection. As would be understood by one having ordinary skill, individual pieces (or "joints") of oilfield tubular members may come in a variety of weights, diameters, configurations, and lengths.

Power tongs are machines that may be used to make-up and break-out threaded connections between adjacent tubular segments by gripping and rotating a first tubular segment relative to a second tubular segment to either make-up or break-out the threaded connection between the two tubular segments. FIG. 1 is a perspective view of an example of an externally gripping power tong 100. The power tong 100 includes a drive motor 110 that may be hydraulically, electrically, and/or pneumatically-powered, and a gripping assembly mechanically coupled to the motor 110 for gripping and rotating a tubular segment received within a bay 106. A generally "C"-shaped gear housing 112 supports a pair of pivoting doors 114. The doors 114 may be closed to secure the bay 106 or swung open (as indicated in FIG. 1) to provide access to the bay 106. The bay 106 is generally surrounded by the gear housing 112. The center of the bay 106 is between a pair of generally opposed pivotable gripping jaws 120, each having a generally arcuate gripping surface disposed radially inwardly toward the center of the bay 119.

Makeup requirements for tubular connections require high torque, such as in the order of thousands, and up to tens of thousands, of ft-lb torque. The components of a power tong must be capable of producing and sustaining the torques required to rotate tubular segments. As such, safely and effectively handling tubular members within an oilfield environment remains a priority to increase the efficiency and effectiveness of such tubular handling equipment.

BRIEF DESCRIPTION OF THE DRAWINGS

For a detailed description of the preferred embodiments of the invention, reference will now be made to the accompanying drawings in which.

DETAILED DESCRIPTION

Figure 1:
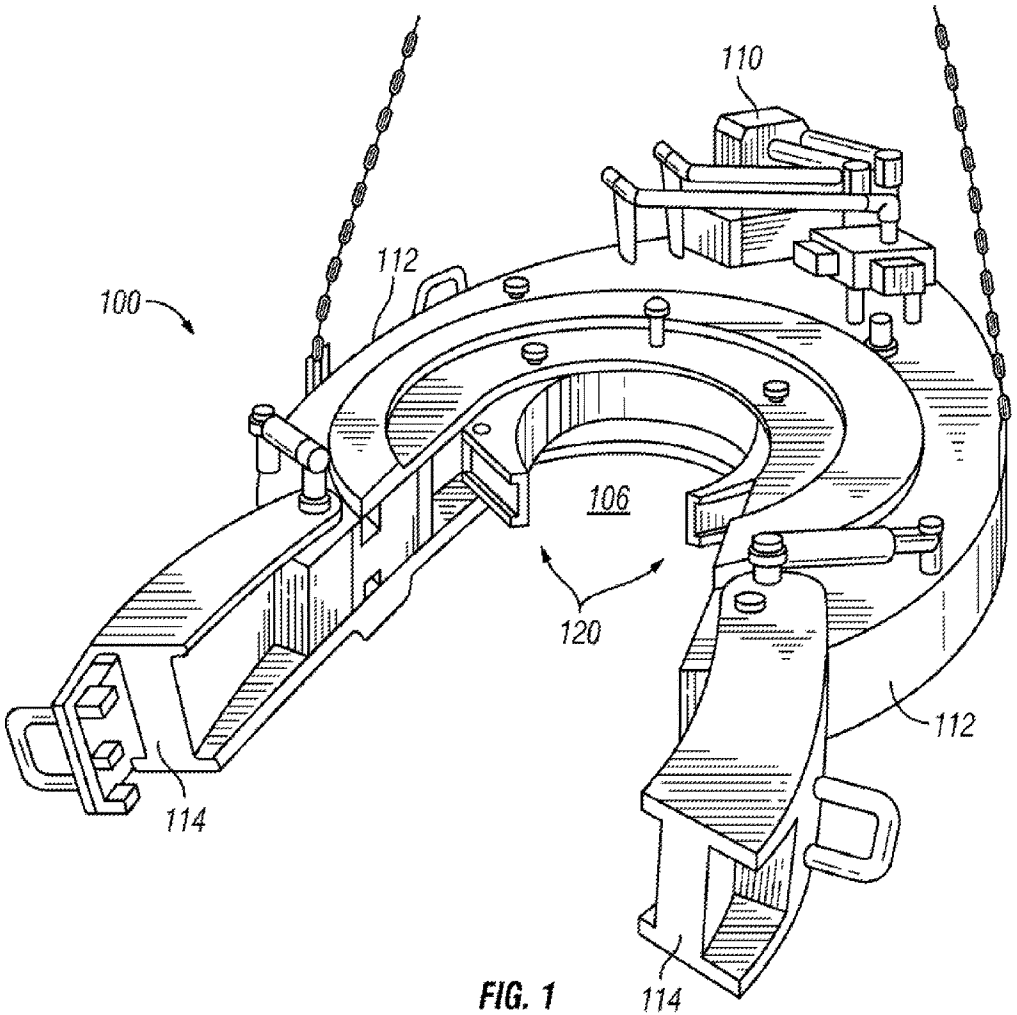
FIG. 1 Prior Art
FIG. 1 shows a perspective view of an externally gripping power tong.

The following discussion is directed to various embodiments of the invention. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct coupling, and the "connect" or "connects" is intended to mean either an indirect or direct connection, unless otherwise denoted. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

In accordance with various aspects disclosed herein, the present disclosure relates to a power tong assembly that may be used to make-up, break-out, and/or torque two or more tubular members, such as within an oilfield exploration and production operation environment discussed above. The power tong assembly includes a power tong is configured to grip and rotate a tubular segment in a first direction, such as to make-up a threaded connection with the tubular segment, and in a second direction, such as to break-out the threaded connection with the tubular segment. The power tong assembly further includes an interlock system operably coupled to the power tong, in which the interlock system may be configured to selectively allow the power tong to rotate the tubular segment in one of the first direction and the second direction while preventing the power tong to rotate the tubular segment in the other of the first direction and the second direction. The interlock system may, additionally or alternatively, be configured to selectively allow the power tong to rotate or not rotate in response to conditions that are sensed by the interlock system.

For example, the power tong may be operated in two directions, such as a make-up direction (e.g., operated in a make-up setting) and a break-out direction (e.g., operated in a break-out setting), in which the make-up setting enables the power tong to rotate a tubular segment in the first direction to make-up a threaded connection with the tubular segment, and the break-out setting enables the power tong to rotate the tubular segment in the second direction to break-out the threaded connection with the tubular segment. Further, the interlock system includes a make-up setting that allows the power tong to rotate the tubular segment in the first direction to make-up the threaded connection with the tubular segment and a break-out setting that allows the power tong to rotate the tubular segment in the second direction to break-out the threaded connection with the tubular segment. As such, the interlock system is configured to prevent the power tong to operate in the make-up setting when the interlock system is in the break-out setting, and further is configured to prevent the power tong to operate in the break-out setting when the interlock system is in the make-up setting.

In one or more embodiments, the power tong may include a high-speed setting to rotate the tubular segment in the first direction and the second direction in a high gear and a low-speed setting to rotate the tubular segment in the first direction and the second direction in a low gear. Accordingly, in one embodiment, the interlock system is configured to allow the power tong to operate in the make-up setting and the high-speed setting only when the interlock system is in the make-up setting, and is configured to allow the power tong to operate in the break-out setting and the high-speed setting only when the interlock system is in the break-out setting. The interlock system may further include a selector mechanism, such as a plug assembly or a three-way valve, which enables the interlock system to move between the make-up setting and the break-out setting. Further, the interlock system may include a power tong gear position sensor. The power tong gear position sensor may be used to sense and determine if the power tong is configured to operate in high gear (e.g., a high-speed setting) or operate in low gear (e.g., a low-speed setting). Accordingly, as discussed more below, the interlock system may use the selector mechanism and/or the power tong gear position sensor to sense the setting or mode of operation of the power tong, in which the interlock system may be configured to selectively allow the power tong to rotate or not rotate in response to conditions that are sensed by the selector mechanism and/or the power tong gear position sensor of the interlock system. Furthermore, the interlock system may be operably coupled to a bi-directional hydraulic motor of the power tong such that the interlock system disables the hydraulic motor to prevent the power tong to rotate the tubular segment in the other of the first direction and the second direction.

In one or more embodiments, the interlock system may include a selector mechanism, in which the selector mechanism may be used as a tong operator interface to switch and move the interlock system between the make-up setting and the break-out setting. In such an embodiment, if the selector mechanism is in the make-up setting (e.g., a make-up position) and the power tong is actuated in the make-up direction, the interlock system may permit the power tong to operate. In particular, the interlock system may permit the power tong to operate in the make-up direction in high-speed (e.g., the high-speed setting) and low-speed (e.g., the low-speed setting) if the selector mechanism of the interlock system is in the make-up position. Further, in such an embodiment, the interlock system may prevent or block the power tong to operate in the break-out direction in high-speed and only permit the power tong to operate in the break-out direction in low-speed if the selector mechanism of the interlock system is in the make-up position.

Further, if the selector mechanism is in the break-out setting (e.g., a break-out position) and the power tong is actuated in the break-out direction, the interlock system may permit the power tong to operate. In particular, the interlock system may permit the power tong to operate in the break-out direction in high-speed and low-speed if the selector mechanism of the interlock system is in the break-out position. Further, in such an embodiment, the interlock system may prevent or block the power tong to operate in the make-up direction in high-speed and only permit the power tong to operate in the make-up direction in low-speed if the selector mechanism of the interlock system is in the break-out position.

Figure 2A:
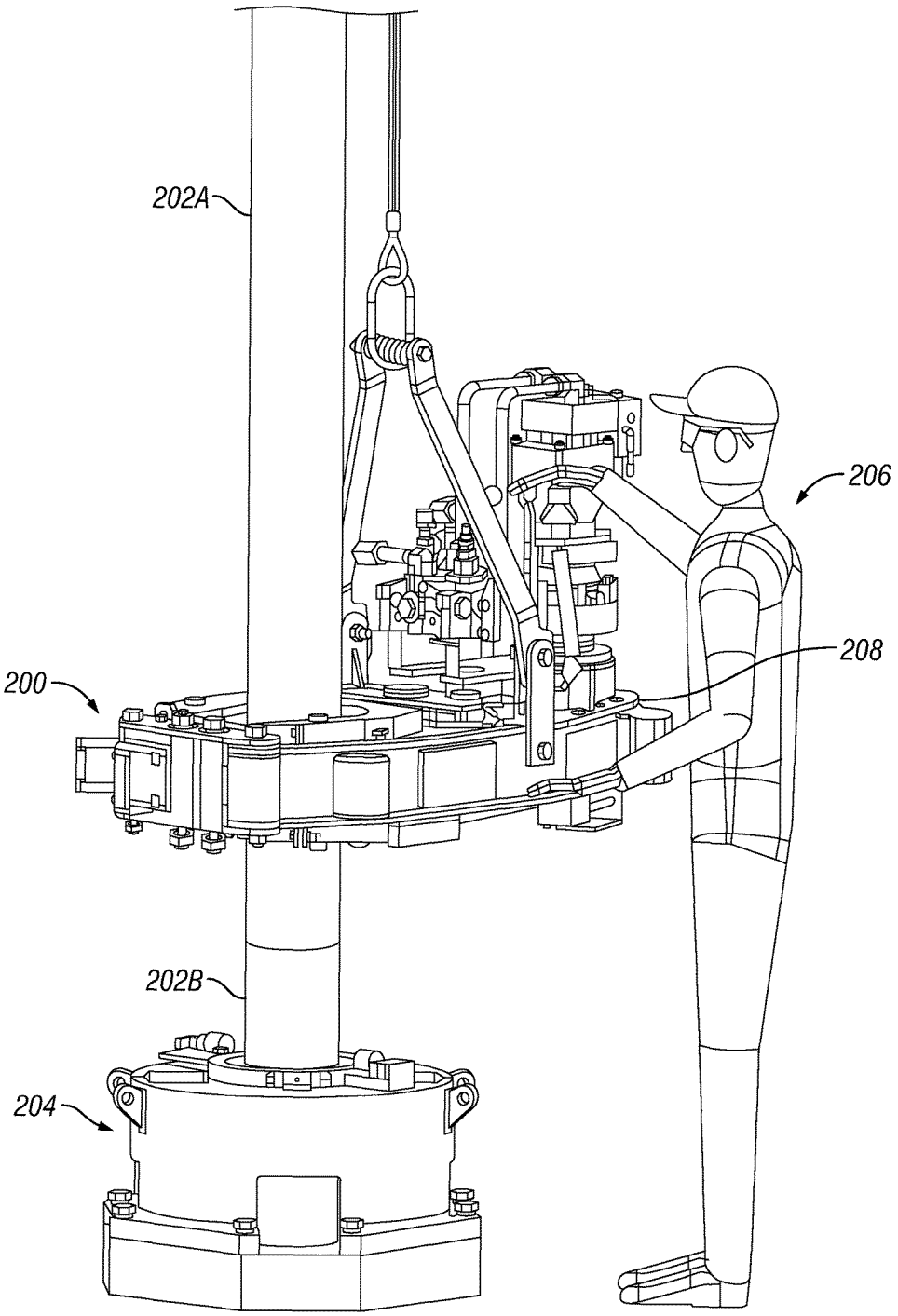
FIGS. 2A-2C show multiple views of a power tong assembly used to grip and rotate a tubular segment in accordance with one or more embodiments of the present disclosure.
Figure 2C:
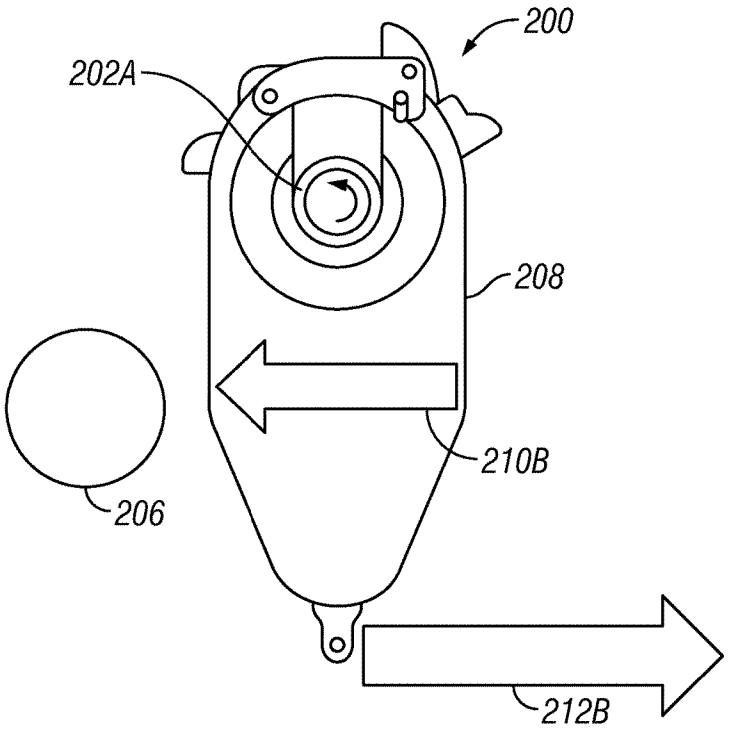
Figure 2B:
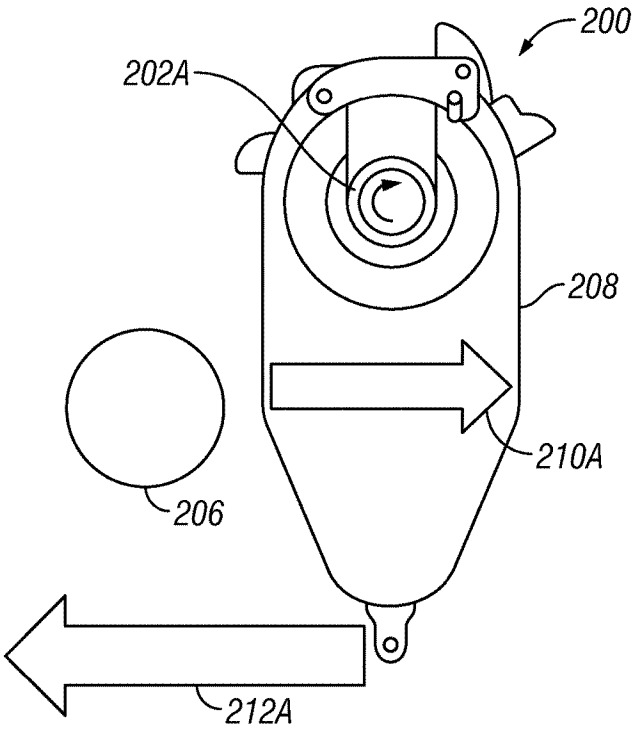

Referring now to FIGS. 2A, 2B, and 2C, multiple views of a power tong assembly 200 used to grip and rotate a tubular segment 202 in accordance with one or more embodiments of the present disclosure are shown. In particular, FIG. 2A shows a perspective view of the power tong assembly 200 when in use to make-up and/or break-out a threaded connection between a first upper tubular segment 202A and a second lower tubular segment 202B, FIG. 2B shows an above schematic view of the power tong assembly 200 when in use to make-up a threaded connection with the tubular segment 202, and FIG. 2C shows another above schematic view of the power tong assembly 200 when in use to break-out a threaded connection with the tubular segment 202.

In one or more embodiments, when making-up and breaking-out threaded connections between tubular segments, a mechanism or component is used to hold reaction torque on one tubular segment while the power tong is used to rotate the other tubular segment. One or more power tong assemblies may include with integral backup wrenches, in which the backup wrench may hold reaction torque on a tubular segment while the power tong makes-up and breaks-out threaded connections by rotating an adjacent tubular segment. In an embodiment in which a power tong assembly does not include an integral backup wrench, such as shown in FIG. 2A, reaction torque may be held on the lower tubular segment 202B using a drilling rotary 204 and/or other tubular gripping mechanism (e.g., a manual tong, a spider, a collar load support), while the power tong assembly 200 is used to rotate and apply torque to the upper tubular segment 202A.

As shown in FIGS. 2A-2C, a tong operator 206 may be in close proximity to the power tong assembly 200, such as particularly when making-up and breaking-out connections. For example, a power tong 208 of the power tong assembly 200 includes a make-up setting and a break-out setting, with the power tong 208 switchable between the make-up and break-out settings. In the make-up setting, the power tong 208 is used to rotate the upper tubular segment 202A in the first direction to make-up a threaded connection between the upper tubular segment 202A and the lower tubular segment 202B, and in the break-out setting, the power tong 208 is used to rotate the upper tubular segment 202A in the second direction to break-out the threaded connection between the upper tubular segment 202A and the lower tubular segment 202B. Furthermore, the power tong 208 may include a high-speed setting and a low-speed setting, with the power tong 208 switchable between the high-speed and low-speed settings. In the high-speed setting, the power tong 208 is used to rotate the upper tubular segment 202A in the first direction or in the second direction in a high gear. In the low-speed setting, the power tong 208 is used to rotate the upper tubular segment 202A in the first direction or in the second direction in a low gear. Accordingly, the tong operator 206 may operate and switch the power tong 208 between each of these different settings.

FIG. 2B shows an example of the power tong 208 when in the make-up setting, in which the power tong 208 is used in this embodiment to rotate the tubular segment 202A in a first direction (e.g., clockwise direction) when making-up threaded connections with the tubular segment 202A. As the power tong 208 rotates the tubular segment 202A in the clockwise direction, the power tong 208 will have the tendency to move and rotate from a reactive torque 210A in the counter-clockwise direction. In one or more embodiments, to prevent movement and rotation of the power tong 208, a snub line 212A may be attached to the power tong 208 in a direction opposite to the reactive torque 210A to prevent movement of the power tong 208 in response to the reactive torque 210A. As such, the snub line 212A may be used in the orientation shown to prevent rotation of the power tong 208 when making-up threaded connections with the tubular segment 202A.

Similarly, FIG. 2C shows an example of the power tong 208 when in the break-out setting, in which the power tong 208 is used in this embodiment to rotate the tubular segment 202A in a second direction (e.g., counter-clockwise direction) when breaking-out threaded connections with the tubular segment 202A. As the power tong 208 rotates the tubular segment 202A in the counter-clockwise direction, the power tong 208 will have the tendency to move and rotate from a reactive torque 210B in the clockwise direction as well. In one or more embodiments, to prevent movement and rotation of the power tong 208, a snub line 212B may be attached to the power tong 208 in a direction opposite to the reactive torque 210A. As such, the snub line 212B may be used to prevent rotation of the power tong 208 when breaking-out threaded connections with the tubular segment 202A.

As shown in FIGS. 2B and 2C, the direction of the attachment of the snub line 212 to the power tong 208 depends on if the power tong 208 is in the make-up setting or the break-out setting. However, as the power tong 208 may not include an integral backup wrench, and is shown to only include the rotary 204 to hold reaction torque, the power tong 208 may present a risk to the tong operator 206. In particular, in the embodiment shown in FIG. 2B, if the tong operator 206 switches the power tong 208 to operate in the break-out setting instead of the make-up setting, the snub line 212A will be ineffective in preventing rotation of the power tong 208. This will allow the power tong 208 to rotate and spin around the tubular segment 202A in the clockwise direction and strike the tong operator 206. This inefficiency is even further magnified if the tong operator 206 is operating the power tong 208 in the high-speed setting, as opposed to the low-speed setting. Similarly, in the embodiment shown in FIG. 2C, if the tong operator 206 switches the power tong 208 to operate in the make-up setting instead of the break-out setting, the snub line 212B will be ineffective in preventing rotation of the power tong 208. This will allow the power tong 208 to rotate and spin around the tubular segment 202A in the counter-clockwise direction and strike the tong operator 206.

Though not shown, the tong operator 206 often operates the power tong 208 from scaffolding or within confined spaces, in which the power tong 208 may then knock the tong operator 206 from the scaffolding and/or smash the tong operator 206 against the structure of a drilling rig, both of which are life-threatening injuries to the tong operator 206. Accordingly, the present disclosure relates to a power tong assembly, in which the power tong assembly includes a power tong and includes an interlock system operably coupled to the power tong, in which the interlock system is configured to selectively allow the power tong to rotate the tubular segment in one of the first direction and the second direction while preventing the power tong to rotate the tubular segment in the other of the first direction and the second direction.

As discussed above, the power tong 208 includes a make-up setting and a break-out setting, which may be operated through one or more handles or levers included with the power tong 208. The make-up setting enables the power tong 208 to rotate the tubular segment 202A in the first direction to make-up a threaded connection with the tubular segment 202A, and the break-out setting enables the power tong 208 to rotate the tubular segment 202A in the second direction to break-out the threaded connection with the tubular segment 202A.

Figure 3A:
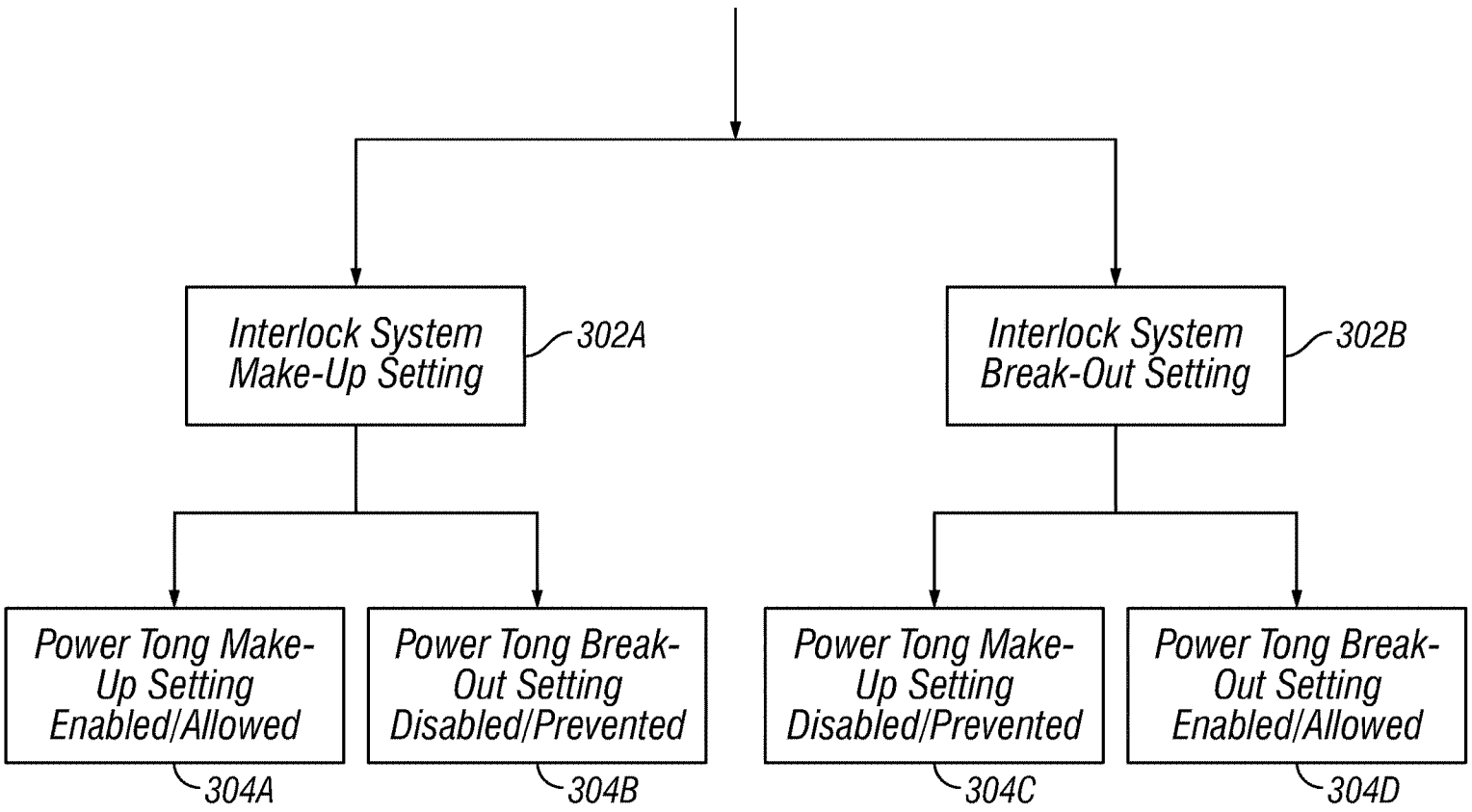
FIGS. 3A-3D show flow charts of operation of a power tong assembly in accordance with one or more embodiments of the present disclosure.

Accordingly, an interlock system in accordance with the present disclosure that is operably coupled to the power tong 208 also includes a make-up setting and a break-out setting, in which the interlock system may be operated using a selector mechanism included within the interlock system. The make-up setting of the interlock system allows the power tong 208 to rotate the tubular segment 202A in the first direction, such as in both the high-speed setting and the low-speed setting, to make-up the threaded connection with the tubular segment 202A, and the break-out setting of the interlock system allows the power tong 208 to rotate the tubular segment 202A in the second direction, such as in both the high-speed setting and the low-speed setting, to break-out the threaded connection with the tubular segment 202A. FIG. 3A shows a flow chart of operation of a power tong assembly in accordance with the present disclosure. As shown, the interlock system may be set in either an interlock system make-up setting 302A or an interlock system break-out setting 302B. When in the interlock system make-up setting 302A, the power tong is enabled/allowed to operate in a power tong make-up setting 304A and is disabled/prevented to operate in a power tong break-out setting 304B. When in the interlock system break-out setting 302B, the power tong is disabled/prevented to operate in a power tong make-up setting 304C and is enabled/allowed to operate in a power tong break-out setting 304D.

As such, with reference to FIGS. 2A-2C, the interlock system is configured to prevent the power tong 208 to operate in the make-up setting when the interlock system is in the break-out setting, and further is configured to prevent the power tong 208 to operate in the break-out setting when the interlock system is in the make-up setting. Such a configuration may provide an additional safety feature to the power tong assembly 200, thereby helping prevent the tong operator 206 from unintentionally making-up and/or breaking-out of threaded connections that may lead to accidents within a drilling environment.

Further, as also discussed above, the power tong 208 may include a high-speed setting and a low-speed setting, which may be operated through one or more handles or levers included with the power tong 208. The high-speed setting enables the power tong 208 to rotate the tubular segment 202A in the first direction and/or the second direction in a high gear, and the low-speed setting enables the power tong 208 to rotate the tubular segment 202A in the first direction and/or the second direction in a low gear.

Accordingly, an interlock system in accordance with the present disclosure may be configured to allow the power tong 208 to operate in the make-up setting and the high-speed setting only when the interlock system is in the make-up setting, and may further be configured to allow the power tong 208 to operate in the break-out setting and the high-speed setting only when the interlock system is in the break-out setting.

Figure 3B:
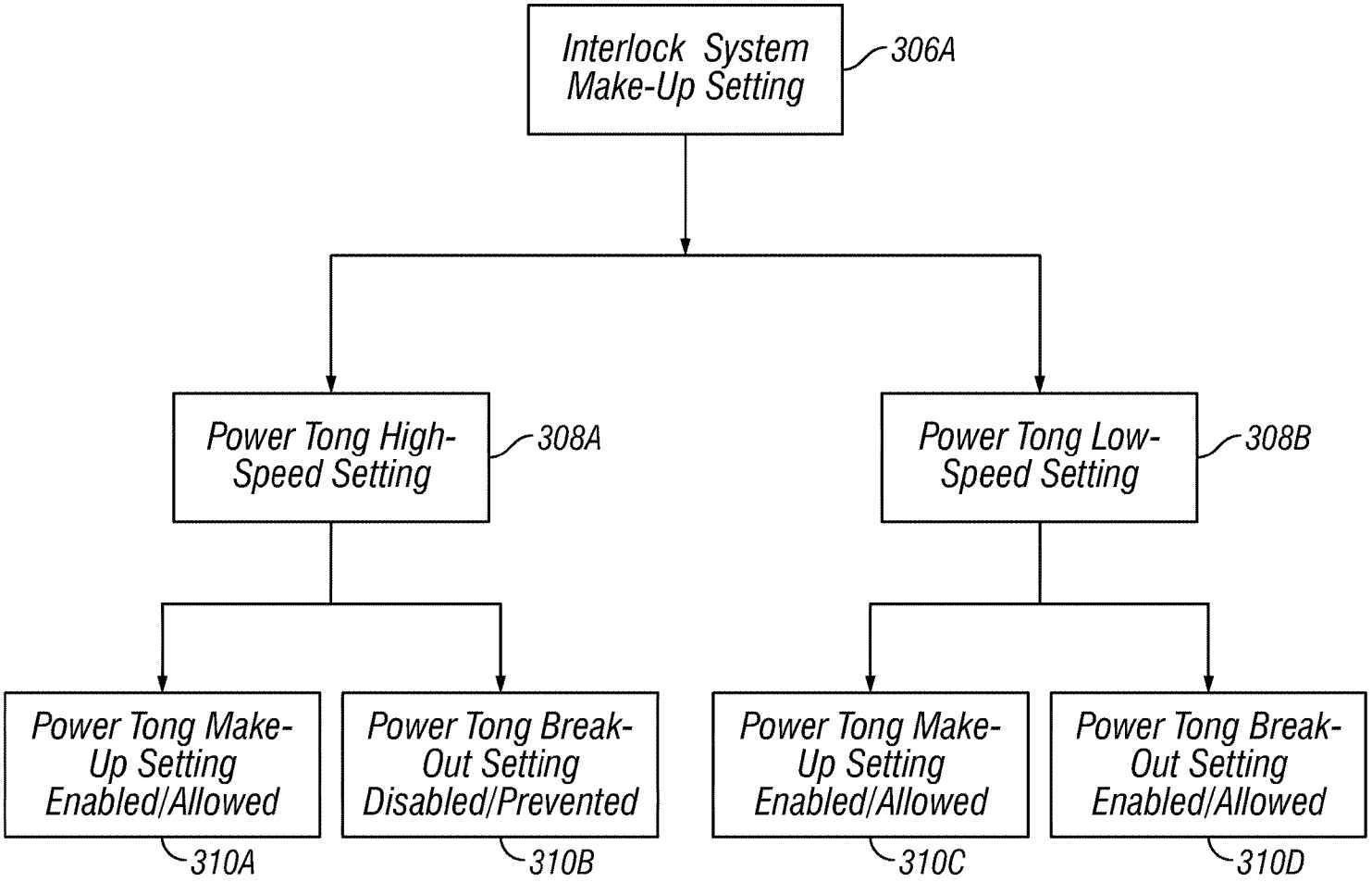

FIG. 3B shows a flow chart of operation of a power tong assembly with an interlock system in a make-up setting in accordance with the present disclosure. The interlock system may be set in an interlock system make-up setting 306A, and the power tong may be set in either a power tong high-speed setting 308A or a power tong low-speed setting 308B. When in the interlock system make-up setting 306A and the power tong high-speed setting 308A, the power tong is enabled/allowed to operate in a power tong make-up setting 310A and is disabled/prevented to operate in a power tong break-out setting 310B. When in the interlock system make-up setting 306A and the power tong low-speed setting 308B, the power tong is enabled/allowed to operate in a power tong make-up setting 310C and is also enabled/allowed to operate in a power tong break-out setting 310D.

Figure 3C:
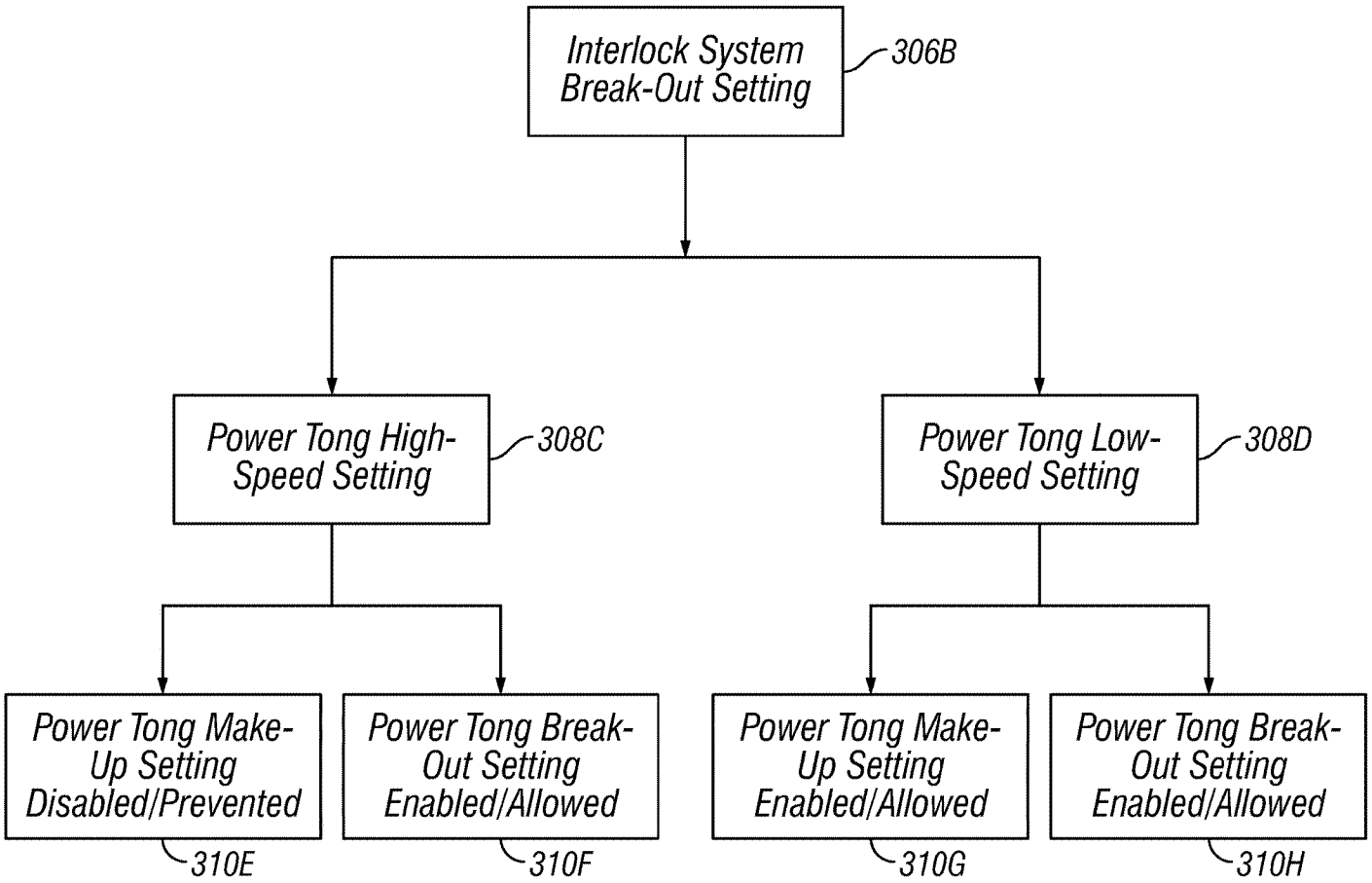

Further, FIG. 3C shows a flow chart of operation of a power tong assembly with an interlock system in a break-out setting in accordance with the present disclosure. The interlock system may be set in an interlock system break-out setting 306B, and the power tong may be set in either a power tong high-speed setting 308C or a power tong low-speed setting 308D. When in the interlock system break-out setting 306B and the power tong high-speed setting 308C, the power tong is disabled/prevented to operate in a power tong make-up setting 310E and is enabled/allowed to operate in a power tong break-out setting 310F. When in the interlock system break-out setting 306B and the power tong low-speed setting 308D, the power tong is enabled/allowed to operate in a power tong make-up setting 310G and is also enabled/allowed to operate in a power tong break-out setting 310H.

Figure 3D:
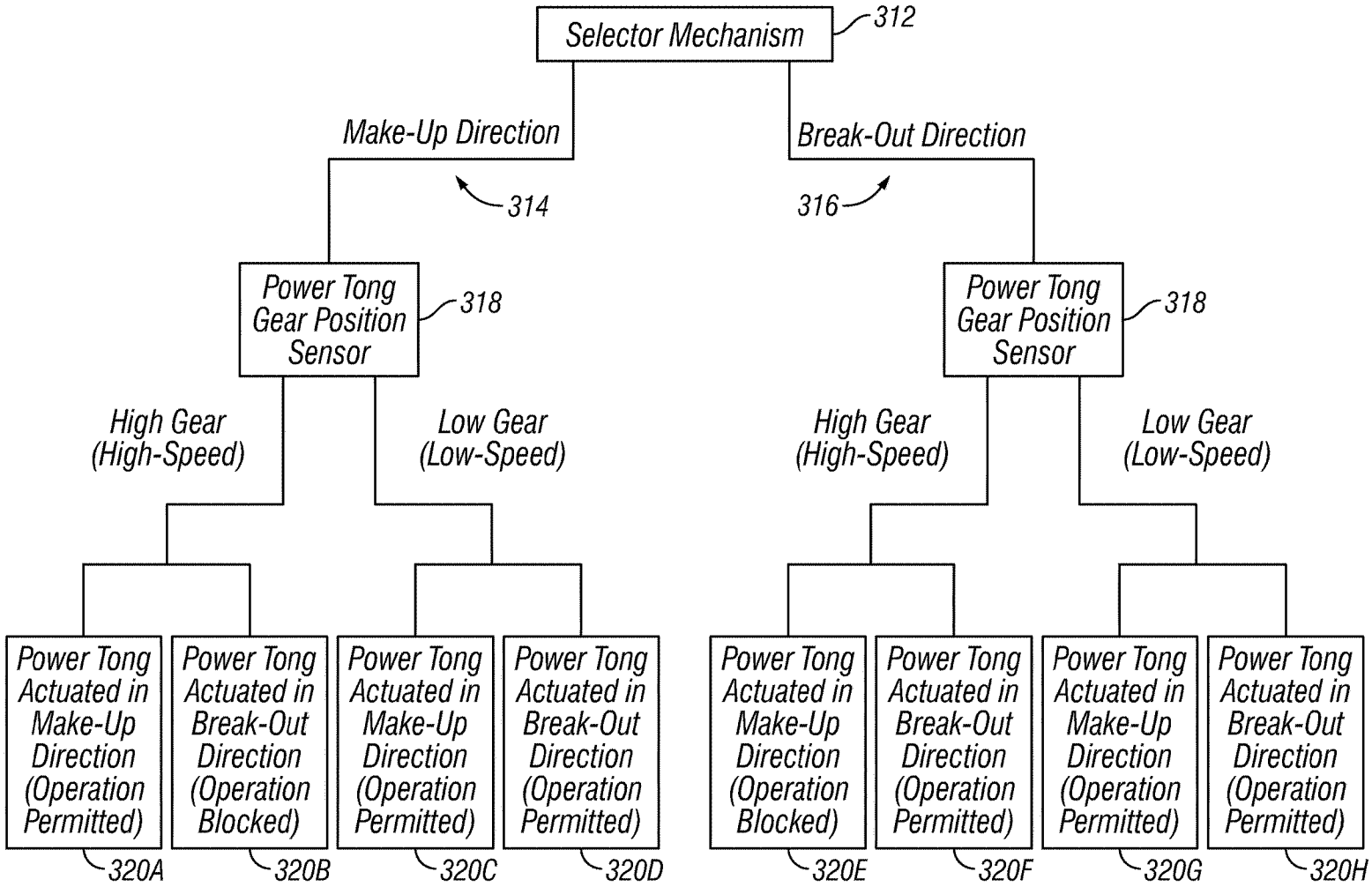

FIG. 3D shows a flow chart of operation of a power tong assembly in accordance with the present disclosure. In one or more embodiments, the interlock system may include a selector mechanism 312, in which the selector mechanism 312 may be used as a tong operator interface to switch and move the interlock system between operating the power tong in a make-up direction 314 or a break-out direction 316. Further, the interlock system may include a power tong gear position sensor 318. The power tong gear position sensor 318 may be used to sense and determine if the power tong is configured to operate in high gear (e.g., a high-speed setting) or operate in low gear (e.g., a low-speed setting). If the selector mechanism 312 is in the make-up setting (e.g., a make-up position) and the power tong gear sensor 318 detects that the power tong is in high gear, the interlock system may permit the power tong to operate in the make-up direction in high gear 320A and prevent or block the power tong to operate in the break-out direction in high gear 320B. If the selector mechanism 312 is in the make-up setting and the power tong gear sensor 318 detects that the power tong is in low gear, the interlock system may permit the power tong to operate in the make-up direction in low gear 320C and permit the power tong to operate in the break-out direction in high gear 320D.

Further, If the selector mechanism 312 is in the break-out setting (e.g., a break-out position) and the power tong gear sensor 318 detects that the power tong is in high gear, the interlock system may prevent or block the power tong to operate in the make-up direction in high gear 320E and permit the power tong to operate in the break-out direction in high gear 320F. If the selector mechanism 312 is in the break-out setting and the power tong gear sensor 318 detects that the power tong is in low gear, the interlock system may permit the power tong to operate in the make-up direction in low gear 320G and permit the power tong to operate in the break-out direction in high gear 320H.

An interlock system in accordance with the present disclosure may have one or more different types of configurations. For example, as shown and discussed below, the interlock system may be hydraulically controlled, in which the interlock system may include one or more hydraulic components and/or actuators and may be used to selectively control hydraulic fluid flow through the power tong. In particular, the interlock system may be used to selectively provide and control a supply of hydraulic fluid to a hydraulic motor of the power tong. However, in another embodiment, the interlock system may additionally or alternatively be magnetically controlled, electrically controlled, mechanically controlled, and/or pneumatically controlled. Accordingly, the present disclosure contemplates other methods and configurations for an interlock system than only those discussed herein, and therefore the present disclosure should not be so limited.

Referring now to FIGS. 4A-4G, multiple views of a power tong assembly 400 in accordance with one or more embodiments of the present disclosure are shown. The power tong assembly 400 includes a power tong 402 used for gripping and rotating tubular segments, particularly for making-up and breaking-out threaded connections, and also includes an interlock system 410. The interlock system 410 is operably coupled to the power tong 402 to selectively allow the power tong to rotate the tubular segment in one of the make-up and the break-out direction while also preventing the power tong 402 from rotating the tubular segment in the other of the make-up and the break-out direction. Accordingly, in this embodiment, the interlock system 410, or at least portions or components thereof, are positioned upon and operably coupled to a motor 404 of the power tong 402. The motor 404 may be a bi-directional hydraulic motor, in which the interlock system 410 may be used to disable the motor 404, such as by limiting hydraulic fluid supply to the motor 404, to prevent the power tong 402 from rotating the tubular segment in an undesired direction or at an undesired speed.

Along with the motor 404, the power tong 402 may include one or more handles 406 to set the power tong 402 in the make-up setting or the break-out setting. For example, in FIG. 4A, one of the handles 406 may be moved to set the power tong 402 in either the make-up setting or the break-out setting, while the other of the handles 406 may be moved to operate a lift cylinder operably coupled to the power tong 402 to selectively raise and lower the power tong 402. The power tong 402 may further include a handle 408 (e.g., speed shifting shaft) to set the power tong 402 in the high-speed setting or the low-speed setting. For example, in FIG. 4A, the handle 408 may be moved in one direction to set the power tong 402 in the high-speed setting or may be moved in another direction to set the power tong 402 in the low-speed setting.

Figures 4A, 4B, 4C:
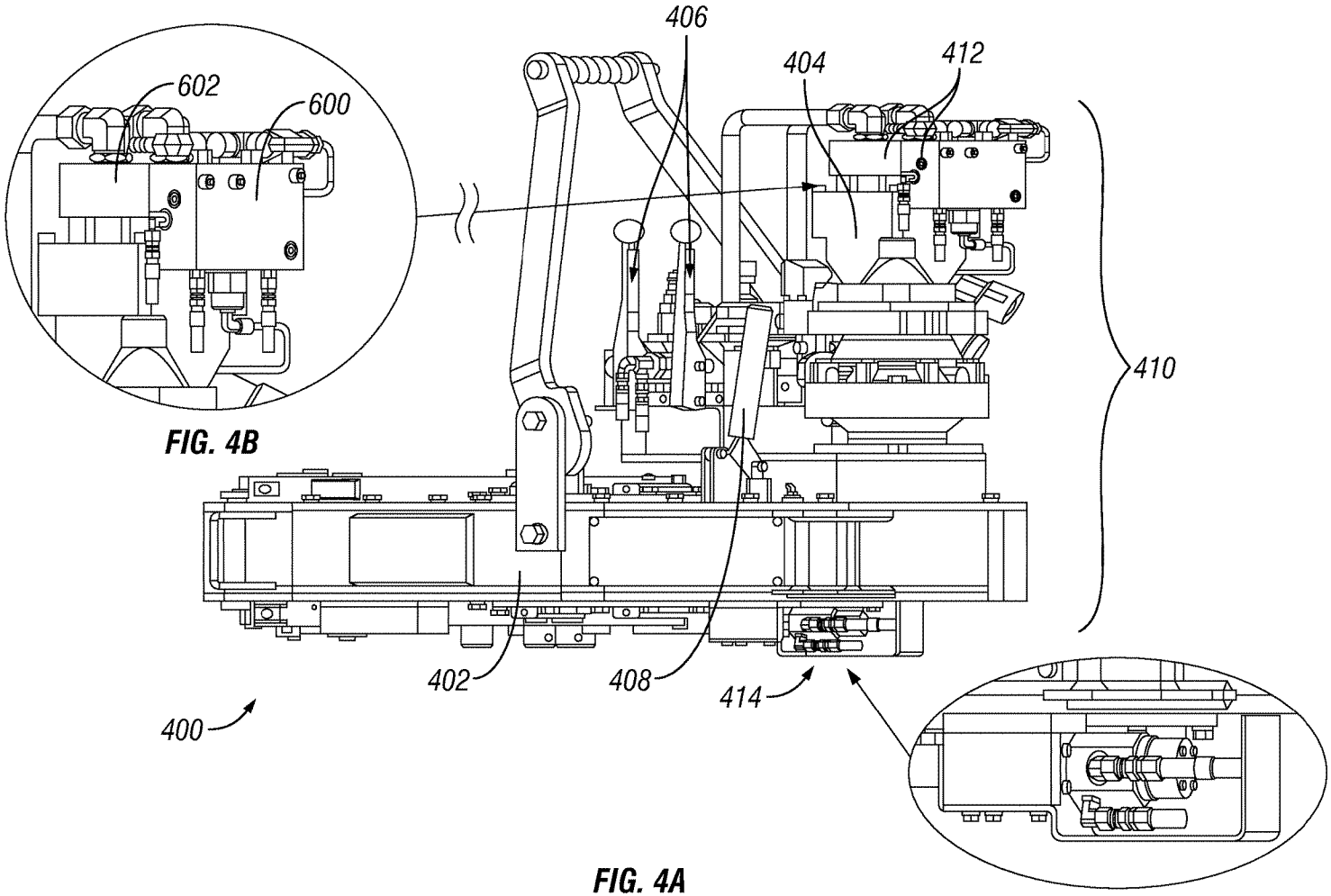
FIGS. 4A-4G show multiple views of a power tong assembly in accordance with one or more embodiments of the present disclosure.

As the interlock system 410 may include multiple portions or components, the interlock system 410 is shown in this embodiment as including a manifold 412, which may be formed as one or more housings, and a speed detection mechanism 414 (e.g., power tong gear position sensor 318). FIG. 4B shows a detailed view of the manifold 412, and FIG. 4C shows a detailed view of the speed detection mechanism 414. The manifold 412 may be positioned on the motor 404 of the power tong 402 and may have hydraulic fluid pumped through the manifold 412. As such, the manifold 412 may include hydraulic logic elements to selectively divert hydraulic fluid flow therethrough, such as including one or more valves, plugs, and/or switches to selectively divert the flow through the manifold 412. In particular, in this embodiment, the manifold 412 may include therewith or therein a selector mechanism 416, a check valve, an orifice or a needle valve, and an unloader valve.

Figure 4D:
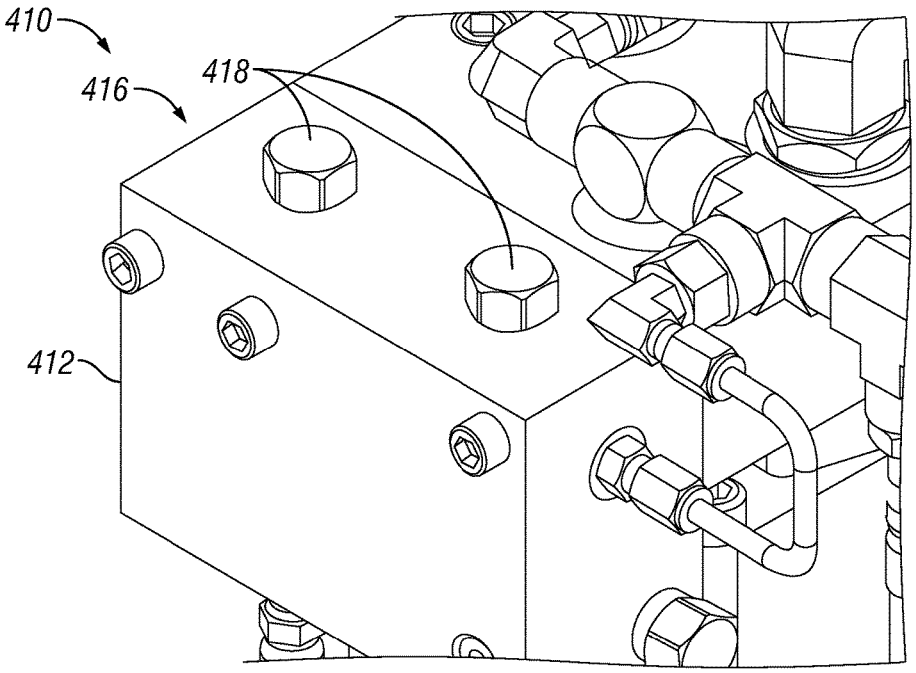
Figure 4E:
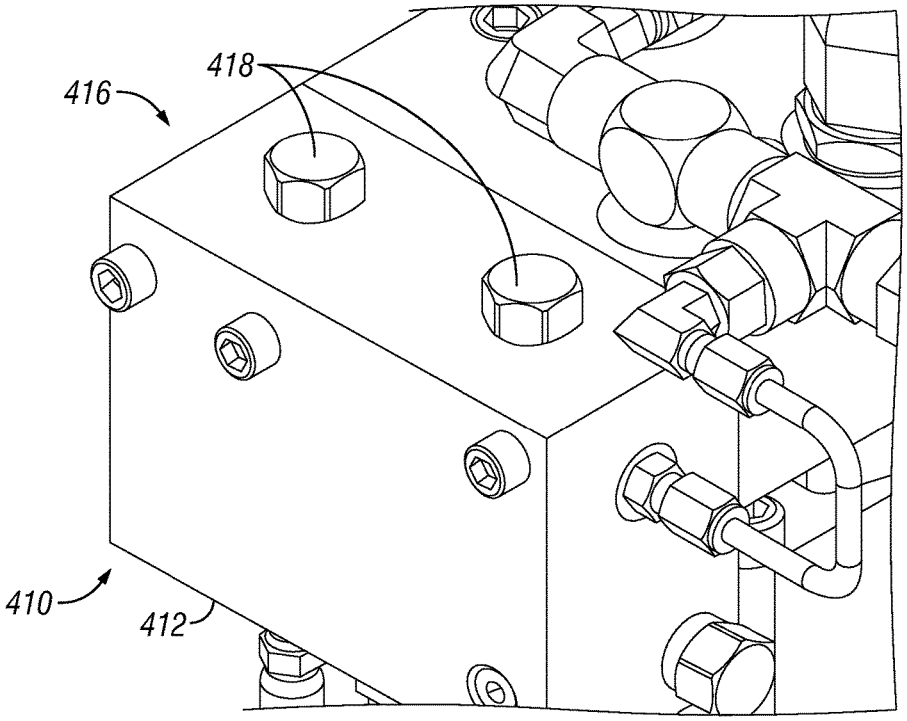
Figure 4F:
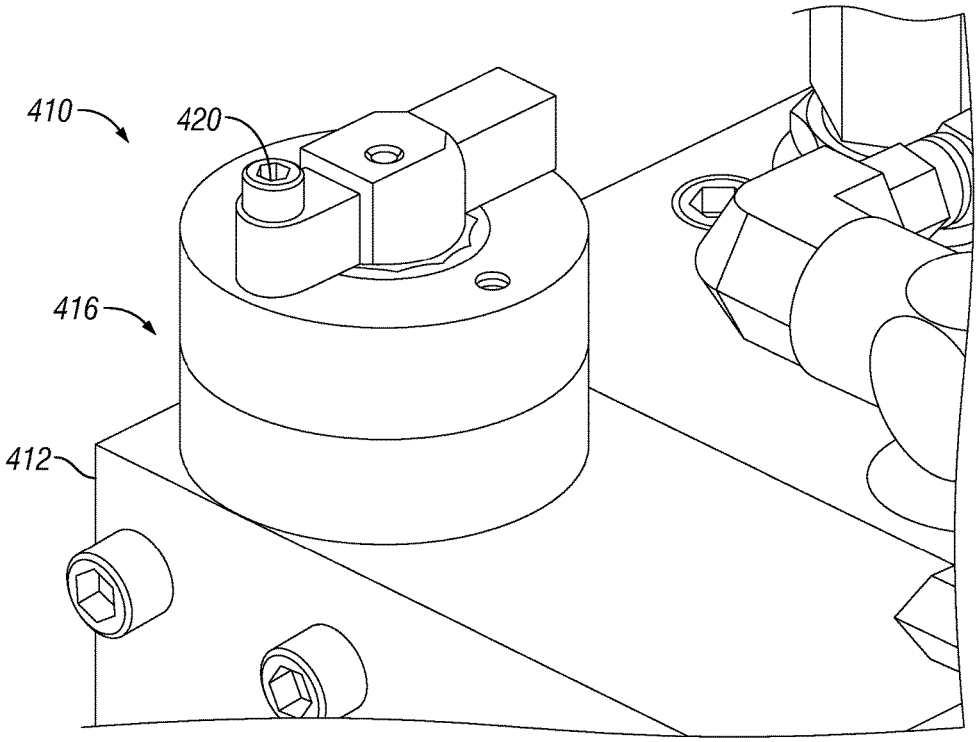

The selector mechanism 416 may be included within the interlock system 410, and may be used as a tong operator interface to switch and move the interlock system 410 between the make-up setting and the break-out setting. Examples of the selector mechanism 416 are shown in FIGS. 4D-4F. In FIGS. 4D and 4E, the selector mechanism 416 is shown as a plug assembly 418 that includes one or more plugs. The plugs of the plug assembly 418 may be rearranged and positioned within the manifold 412 to set the interlock system 410 in a make-up setting (e.g., high-speed make-up setting), as shown in FIG. 4D, or to set the interlock system 410 in a break-out setting (e.g., high-speed break-out setting), as shown in FIG. 4E. Alternatively, the selector mechanism 416 is shown as a three-way valve 420 in FIG. 4F, such as a three-way ball valve, in which the three-way valve 420 may be set and moved between the make-up setting and the break-out setting.

Figure 4G:
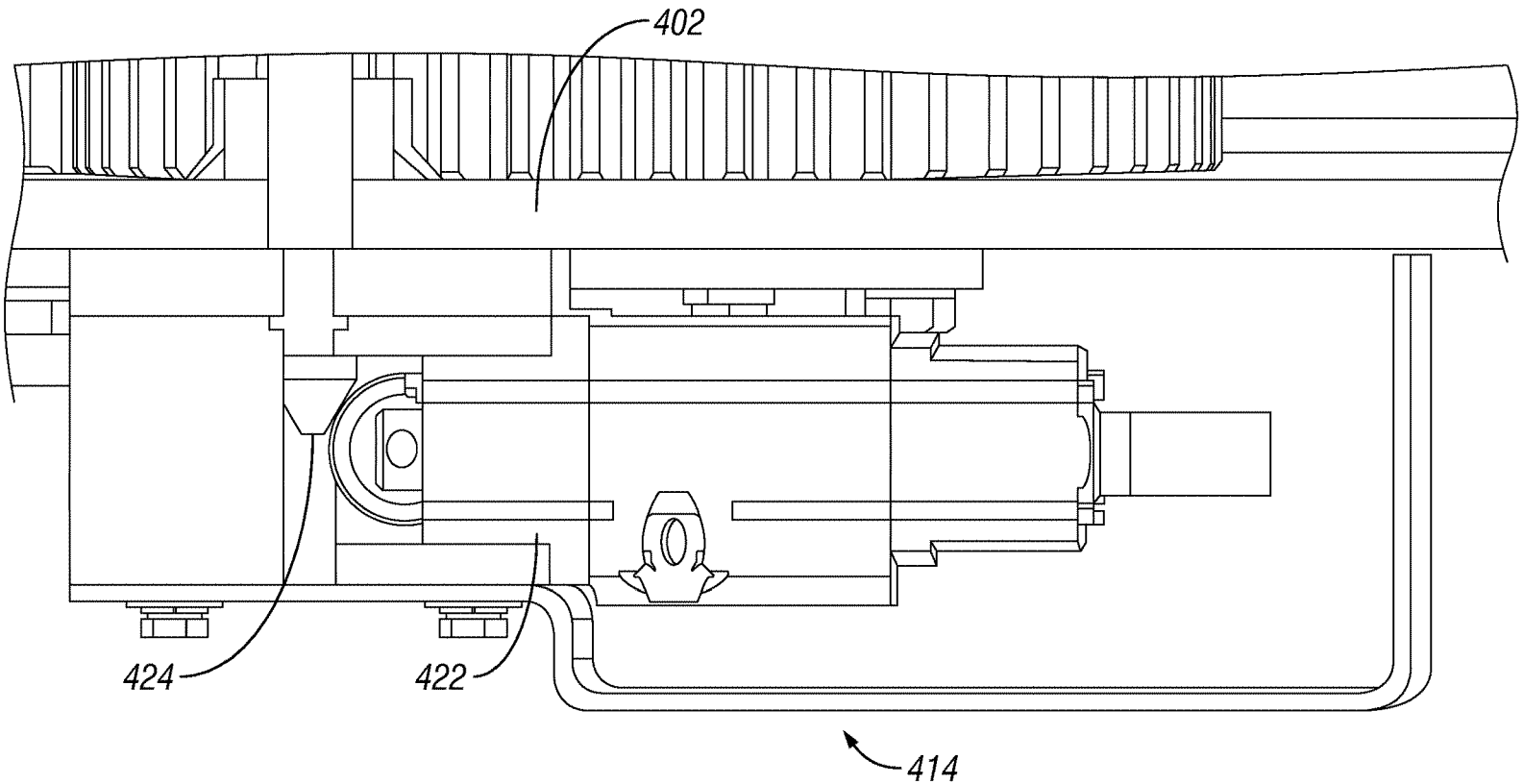

The speed detection mechanism 414 may be operably coupled to the handle 408 that shifts the power tong 402 between the high-speed setting and the low-speed setting. Accordingly, the speed detection mechanism 414 may be positioned adjacent the handle 408, such as positioned on the bottom of the power tong 402. In this embodiment, the speed detection mechanism 414 may include a cam-operated valve 422. FIG. 4G shows a cross-sectional view of the cam-operated valve 422. As such, the cam-operated valve 422 is activated and moved between an open position and a closed position based on movement of a camming rod 424. The camming rod 424 may be coupled to the handle 408, and therefore the camming rod 424 may move with the handle 408 when shifting the power tong 402 between the high-speed setting and the low-speed setting. Accordingly, the cam-operated valve 422 may detect the speed of the power tong 402, such as if the power tong 402 is in the high-speed setting or the low-speed setting, based upon the position and movement of the camming rod 424.

Figure 5A:
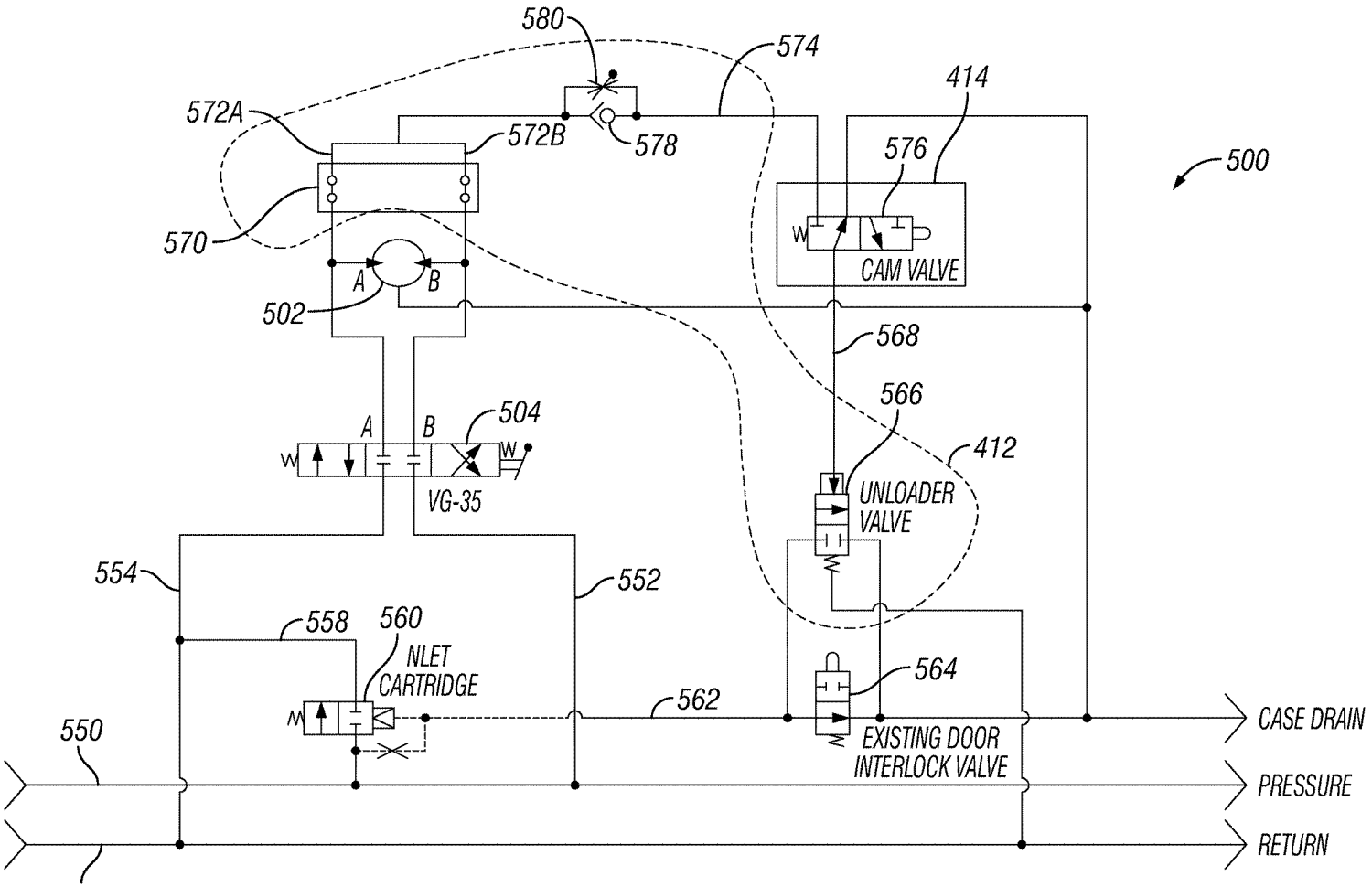
FIGS. 5A and 5B show multiple schematic views of a simplified hydraulic circuit for a power tong assembly in accordance with one or more embodiments of the present disclosure.
Figure 5B:
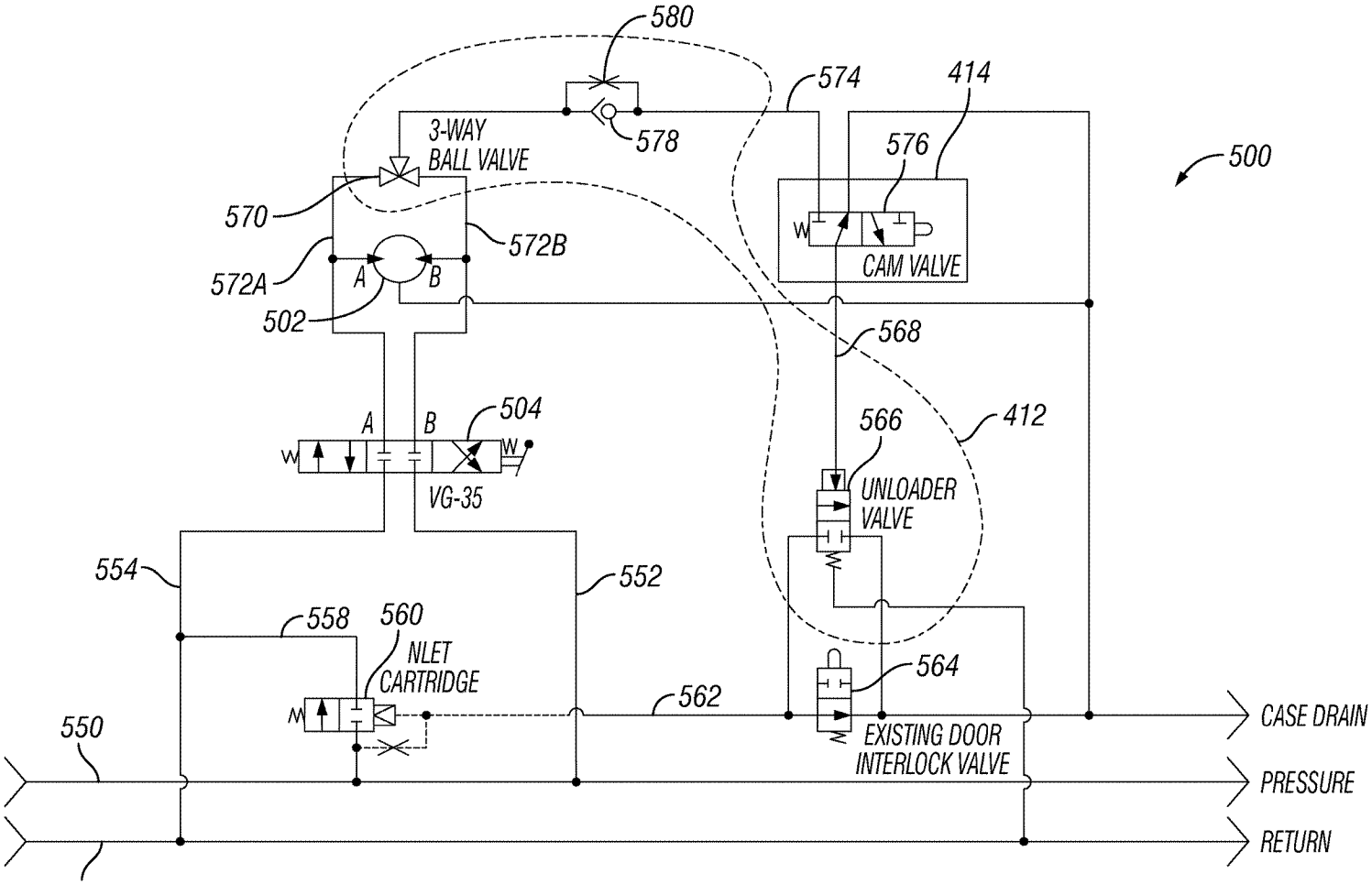

Referring now to FIGS. 5A and 5B, multiple schematic views of a simplified hydraulic circuit 500 for a power tong assembly in accordance with one or more embodiments of the present disclosure are shown. As shown in this embodiment, the hydraulic circuit 500 includes a hydraulic motor 502 (e.g., bi-directional hydraulic motor), such as the motor 404 shown in FIG. 4A, and a directional control valve 504 (e.g., four-way, three-position directional control valve) that controls fluid flow to the hydraulic motor 502. The directional control valve 504 may include or be operably coupled to the handles 406 of the power tong 402. As such, the directional control valve 504 may be used to control the direction of rotation of the hydraulic motor 502, and therefore may be used to move the power tong 402 between the make-up setting and the break-out setting. Hydraulic fluid may be provided along a pressure flow path 550 and flow through a motor inlet flow path 552 into the directional control valve 504. The directional control valve 504 may then be used to selectively flow the hydraulic fluid into either the A-side or the B-side of the hydraulic motor 502, depending on the desired rotation of the power tong 402. Hydraulic fluid may then return from the hydraulic motor 502 back into the directional control valve 504, in which hydraulic fluid may then be provided to a return flow path 556 through a motor outlet flow path 554.

The hydraulic circuit 500 may further include a bypass flow path 558, in which the bypass flow path 558 may be used to directly route hydraulic fluid from the pressure flow path 550 to the motor outlet flow path 554 and/or directly to the return flow path 556. The bypass flow path 558 may include a directional control valve 560 (e.g., two-way, two-position directional control valve) fluidly coupled thereto, in which the directional control valve 560 may include a pilot-operated valve and/or a cartridge valve. As shown in FIGS. 5A and 5B, the directional control valve 560 may be pilot-operated into the closed position, in which the directional control valve 560 may be opened when pilot pressure to the directional control valve 560 is relieved along a case drain flow path 562. When the control valve 560 opens, hydraulic fluid flows along the bypass flow path 558 instead of the motor inlet flow path 552, thereby disabling and preventing the hydraulic motor 502 from operation.

The directional control valve 560, as shown in the embodiment in FIGS. 5A and 5B, may be opened from operation of either a directional control valve 564 or a directional control valve 566 fluidly coupled in parallel to the directional control valve 560 along the case drain flow path 562. The directional control valve 564 (e.g., two-way, two-position directional control valve) may include an interlock valve that is movable between the open and closed position based upon an open or closed position of a door of the power tong 402. If the door of the power tong 402 is opened, the directional control valve 564 may relieve pilot pressure to the directional control valve 560 along the case drain flow path 562, thereby opening the directional control valve 560 and preventing operation of the hydraulic motor 502.

Further, the directional control valve 566 (e.g., two-way, two-position directional control valve), which may include an unloader valve as shown in FIGS. 5A and 5B, may be movable between the open and closed position based upon a pilot pressure received along a pilot flow path 568. If pilot pressure is received along the pilot flow path 568 to the directional control valve 566, the directional control valve 566 will open, thereby relieving pilot pressure to the directional control valve 560 along the case drain flow path 562, opening the directional control valve 560, and preventing operation of the hydraulic motor 502. Otherwise, if enough pilot pressure is not received along the pilot flow path 568 to open the directional control valve 566, pilot pressure will be maintained to keep the directional control valve 560 closed and the hydraulic motor 502 operational.

Referring still to FIGS. 5A and 5B, the hydraulic circuit 500 includes a direction detection portion or a selector mechanism 570, such as the selector mechanism 416 of the interlock system 410 shown in FIGS. 4A-4G, that may be used to selectively fluidly couple an A-side motor flow path 572A or a B-side motor flow path 572B to a pilot flow path 574. As discussed above, the selector mechanism 570 may be used to switch and move the interlock system 410 between the make-up setting and the break-out setting. The direction detection portion or selector mechanism 570 shown in FIG. 5A is a schematic symbol for the plug assembly 418 shown in FIGS. 4D and 4E, and the direction detection portion or selector mechanism 570 shown in FIG. 5B is a schematic symbol for the three-way valve 420 shown in FIG. 4F.

The hydraulic circuit 500 may further include a directional control valve 576 (e.g., three-way, two-position directional control valve), which may be the cam-operated valve 422 of the speed detection mechanism 414 shown in FIGS. 4A, 4C, and 4G. The directional control valve 576 may be movable between the open and closed position based upon if the power tong 402 is in the high-speed setting and the low-speed setting. As such, in this embodiment, the directional control valve 576 may be in the open position when the power tong 402 is in the high-speed setting, thereby fluidly coupling the pilot flow path 574 to the pilot flow path 568. Further, as shown in FIGS. 5A and 5B, the directional control valve 576 may be in the closed position when the power tong 402 is in the low-speed setting, thereby preventing fluid from flowing from the pilot flow path 574 to the pilot flow path 568. Furthermore, the hydraulic circuit 500 may include a check valve 578 and an orifice or a needle valve 580. The check valve 578 and the needle valve 580 may be in parallel with each other, as shown, and may be fluidly coupled to the pilot flow path 574 or the pilot flow path 568.

In operation, the selector mechanism 570 may be used to either allow fluid flow through the A-side motor flow path 572A or the B-side motor flow path 572B and into the pilot flow path 574. When the A-side motor flow path 572A is open with fluid allowed to flow therethrough, the A-side of the hydraulic motor 502 is not operational. For example, hydraulic fluid may be provided along the motor inlet flow path 552, into the directional control valve 504, and towards the A-side of the hydraulic motor 502. As the A-side motor flow path 572A is open, hydraulic fluid will flow into the A-side motor flow path 572A and continue along the pilot flow path 574. If the directional control valve 576 is present and open (e.g., the power tong 402 is in the high-speed setting), hydraulic fluid may flow from the pilot flow path 574 to the pilot flow path 568 to provide pilot pressure to the directional control valve 566. When pilot pressure is received along the pilot flow path 568 to the directional control valve 566, the directional control valve 566 will open, thereby relieving pilot pressure to the directional control valve 560 along the case drain flow path 562, opening the directional control valve 560, and preventing operation of the hydraulic motor 502.

Similarly, when the B-side motor flow path 572B is open with fluid allowed to flow therethrough, the B-side of the hydraulic motor 502 is not operational. For example, hydraulic fluid may be provided along the motor inlet flow path 552, into the directional control valve 504, and towards the B-side of the hydraulic motor 502. As the B-side motor flow path 572B is open, hydraulic fluid will flow along the B-side motor flow path 572B and continue along the pilot flow path 574. The hydraulic fluid may then flow from the pilot flow path 574 to the pilot flow path 568 to provide pilot pressure to the directional control valve 566.

In an embodiment in which hydraulic fluid received through the A-side of the hydraulic motor 502 causes the power tong 402 to make-up threaded connections with a tubular segment, the right side of the directional control valve 504 may be used as the make-up setting for the power tong 402, and the opening the B-side motor flow path 572B may be used as the make-up setting for the selector mechanism 570 (e.g., selector mechanism 416). In such an embodiment, the hydraulic motor 570 may, thus, be disabled when the directional control valve 504 is switched to the left side for the break-out setting of the power tong 402, thereby disabling and preventing the hydraulic motor 570, and the power tong 402, from operating in the break-out setting when the interlock system 410 is in the make-up setting.

Similarly, in an embodiment in which hydraulic fluid received through the B-side of the hydraulic motor 502 causes the power tong 402 to break-out threaded connections with a tubular segment, the left side of the directional control valve 504 may be used as the break-out setting for the power tong 402, and the opening the A-side motor flow path 572A may be used as the break-out setting for the selector mechanism 570 (e.g., selector mechanism 416). In such an embodiment, the hydraulic motor 570 may, thus, be disabled when the directional control valve 504 is switched to the right side for the make-up setting of the power tong 402, thereby disabling and preventing the hydraulic motor 570, and the power tong 402, from operating in the make-up setting when the interlock system 410 is in the break-out setting.

As shown and discussed above, the interlock system 410 may include a manifold 412, in which the manifold 412 may include hydraulic logic elements to selectively divert hydraulic fluid flow therethrough. Accordingly, as shown in FIGS. 5A and 5B, the manifold 412 may include the selector mechanism 570, the directional control valve 566, the check valve 578, and the orifice or needle valve 580. The check valve 578 and the orifice or needle valve 580 may be used to maintain pressure on the directional control valve 566 through the pilot flow path 574, the directional control valve 576, and the pilot flow path 568. The check valve 574 enables hydraulic fluid to pass across and enter into the pilot flow path 568 and open the directional control valve 566 (e.g., enter a pilot cavity of the unloader valve). The orifice or needle valve 580 may enable the pressure from the hydraulic fluid to then be maintained within the pilot flow path 568 and upon the directional control valve 566 (e.g., maintain pressure within the pilot cavity of the unloader valve) by slowing and regulating the flow of hydraulic fluid away from the pilot flow path 568.

Further, as discussed above, the directional control valve 566 (e.g., unloader valve) may be used as a disabling portion within the interlock system to disable and prevent rotation of the power tong based a speed detection portion (e.g., a directional control valve 576 and/or a cam-operated valve 422) and the direction detection portion (e.g., selector mechanism 570). For example, when pilot pressure is received along the pilot flow path 568 to the directional control valve 566, the directional control valve 566 will open, thereby relieving pilot pressure to the directional control valve 560 along the case drain flow path 562. This enables the directional control valve 560 to open, in which hydraulic fluid then flows along the bypass flow path 558 instead of the motor inlet flow path 552, thereby disabling and preventing the hydraulic motor 502 from operation.

Accordingly, a power tong assembly including a power tong and an interlock system in accordance with the present disclosure may include one or more advantages, such as by decreasing the likelihood of an accident when operating a power tong. In particular, the interlock system is configured to selectively allow the power tong to rotate the tubular segment in one of the first direction and the second direction while preventing the power tong to rotate the tubular segment in the other of the first direction and the second direction. As such, the interlock system may be used to prevent the power tong from operating in a direction unintended by a tong operator, thereby preventing damage to the power tong, to the tubular segments handled by the power tong, and the tong operator.

Although the present invention has been described with respect to specific details, it is not intended that such details should be regarded as limitations on the scope of the invention, except to the extent that they are included in the accompanying claims.

What is claimed is:

1. A power tong assembly, comprising:

a power tong configured to grip and rotate a first tubular segment;

a make-up setting to rotate the first tubular segment in a first direction to make-up a threaded connection with a second tubular segment;

a break-out setting to rotate the first tubular segment in a second direction to break-out the threaded connection with the second tubular segment;

a high-speed setting to rotate the first tubular segment in the first direction and the second direction in a high gear;

a low-speed setting to rotate the first tubular segment in the first direction and the second direction in a low gear; and an interlock system operably coupled to the power tong, the interlock system configured to allow the power tong to operate in the make-up setting and the break-out setting when in the low-speed setting, and configured to allow the power tong to operate in only one of the make-up setting and the break-out setting when in the high-speed setting.

2. The power tong assembly of claim 1, wherein the interlock system further comprises a selector mechanism that enables the interlock system to move between the make-up setting and the break-out setting, wherein the selector mechanism comprises a plug assembly or a three-way valve.

3. The power tong assembly of claim 1, wherein the interlock system comprises:

a direction detection portion configured to determine if the power tong is in one of the make-up setting and the break-out setting;

a speed detection portion configured to determine if the power tong is in one of the high-speed setting and the low-speed setting; and a disabling portion configured to prevent rotation of the power tong based upon a signal received from the speed detection portion and the direction detection portion.

4. The power tong assembly of claim 3, wherein the speed detection portion comprises a cam-operated valve, wherein the direction detection portion comprises a plug assembly or a three-way valve, and wherein the disabling portion comprises an unloader valve.

5. The power tong assembly of claim 3, wherein the speed detection portion is operably coupled to a speed shifting shaft of the power tong, and wherein a hydraulic manifold operably coupled to a hydraulic motor of the power tong comprises the direction detection portion and the disabling portion.

6. The power tong assembly of claim 1, wherein the interlock system is operably coupled to a bi-directional hydraulic motor of the power tong such that the interlock system disables the bi-directional hydraulic motor to prevent the power tong to rotate the first tubular segment in the other of the first direction and the second direction.

7. A power tong assembly, comprising:

a power tong comprising:

a high-speed setting to rotate a tubular segment in a first direction and a second direction in a high gear;

a low-speed setting to rotate the tubular segment in the first direction and the second direction in a low gear;

a make-up setting to rotate the tubular segment in the first direction to make-up a threaded connection with a second tubular segment; and a break-out setting to rotate the tubular segment in the second direction to break-out the threaded connection with the second tubular segment; and an interlock system comprising:

a make-up setting; and a break-out setting;

wherein:

the interlock system is configured to allow the power tong to operate in the high-speed setting in the make-up direction only when the interlock system is in the make-up setting; and the interlock system is configured to allow the power tong to operate in the high-speed setting in the break-out direction only when the interlock system is in the break-out setting.

8. The power tong assembly of claim 7, wherein the interlock system further comprises a selector mechanism that enables the interlock system to move between the make-up setting and the break-out setting, wherein the selector mechanism comprises a plug assembly or a three-way valve.

* * * * *